US005234283A

United States Patent [19]

Adkins

[11] Patent Number: 5,234,283

[45] Date of Patent: Aug. 10, 1993

[54] VIBRATORY CONCRETE FLOAT APPARATUS

[76] Inventor: Arthur D. Adkins, 9485 McAfee Rd., Montrose, Mich. 48457

[21] Appl. No.: 824,376

[22] Filed: Jan. 23, 1992

[51] Int. Cl.[5] ..... E01C 19/22

[52] U.S. Cl. ..... 404/97; 404/114

[58] Field of Search ..... 404/97, 133.1, 114, 404/113

[56] References Cited

U.S. PATENT DOCUMENTS

| | | | |
|---|---|---|---|
| 2,400,341 | 5/1946 | Day et al. | 404/113 |
| 2,514,626 | 7/1950 | Clipson | 404/113 |
| 4,343,568 | 8/1982 | Kaltenegger | 404/114 X |
| 4,641,995 | 2/1987 | Owens | 404/114 X |
| 4,650,366 | 3/1987 | Morrison | 404/114 |
| 4,653,957 | 3/1987 | Smith et al. | 404/97 X |
| 4,798,494 | 1/1989 | Allen | 404/114 |
| 4,892,447 | 11/1990 | Kraft | 404/97 |

*Primary Examiner*—William P. Neuder
*Attorney, Agent, or Firm*—Leon Gilden

[57] ABSTRACT

A float plate includes vibratory members secured in operative relationship thereto to effect vibration of the float during a concrete finishing procedure. A modification of the invention includes the apparatus to have fluid dispersion structure to enhance ease of a finishing of an underlying concrete pad. Illumination members are optionally provided for the use of the organization during periods of limited available light.

3 Claims, 5 Drawing Sheets

VIBRATORY CONCRETE FLOAT APPARATUS

BACKGROUND OF THE INVENTION

1. Field of the Invention

The field of invention relates to concrete finishing apparatus, and more particularly pertains to a new and improved vibratory concrete float apparatus wherein the same is arranged for the finishing of a concrete surface.

2. Description of the Prior Art

The use of vibratory energy directed to a float structure relative to a concrete finishing procedure is available in the prior art and exemplified by the U.S. Pat. No. 4,798,494 to Allen wherein a pneumatically driven vibratory device is mounted to a float structure.

The U.S. Pat. No. 4,838,730 to Owens sets forth a further example of a concrete finishing organization further utilizing pneumatic vibratory devices.

The instant invention attempts to overcome deficiencies of the prior art by employing a flexible cable drive, or alternatively the use of a handle mounted vibratory device to enhance efficiency and minimize accessory structure to unencumber an operator in use of the organization.

As such, it may be appreciated that there continues to be a need for a new and improved vibratory concrete float apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of concrete float apparatus now present in the prior art, the present invention provides a vibratory concrete float apparatus wherein the same is arranged to impart a vibratory energy to a float structure to effect efficiency in a finishing procedure relative to a concrete float. As such, the general purpose of the present invention, which will be described subsequently in greater detail, is to provide a new and improved vibratory concrete float apparatus which has all the advantages of the prior art concrete float apparatus and none of the disadvantages.

To attain this, the present invention provides a float plate including vibratory members secured in operative relationship thereto to effect vibration of the float during a concrete finishing procedure. A modification of the invention includes the apparatus to have fluid dispersion structure to enhance ease of a finishing of an underlying concrete pad. Illumination members are optionally provided for the use of the organization during periods of limited available light.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved vibratory concrete float apparatus which has all the advantages of the prior art concrete float apparatus and none of the disadvantages.

It is another object of the present invention to provide a new and improved vibratory concrete float apparatus which may be easily and efficiently manufactured and marketed.

It is a further object of the present invention to provide a new and improved vibratory concrete float apparatus which is of a durable and reliable construction.

An even further object of the present invention is to provide a new and improved vibratory concrete float apparatus which is susceptible of a low cost of manufacture with regard to both materials and labor, and which accordingly is then susceptible of low prices of sale to the consuming public, thereby making such vibratory concrete float apparatus economically available to the buying public.

Still yet another object of the present invention is to provide a new and improved vibratory concrete float apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
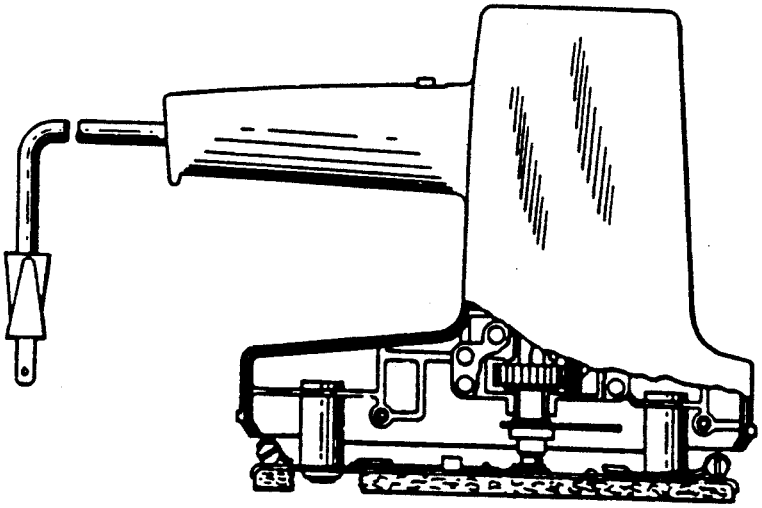
FIG. 1 PRIOR ART
FIG. 1 is an orthographic view, partially in section, of a prior art vibratory device, as set forth in the U.S. Pat. No. 3,918,214 relative to show structure providing direct vibratory energy to an associated tool surface.

With reference now to the drawings, and in particular to FIGS. 1 to 8 thereof, a new and improved vibratory concrete float apparatus embodying the principles and concepts of the present invention and generally designated by the reference numerals 10, 10*a*, 10*b*, and 10*c* will be described.

Figure 2:
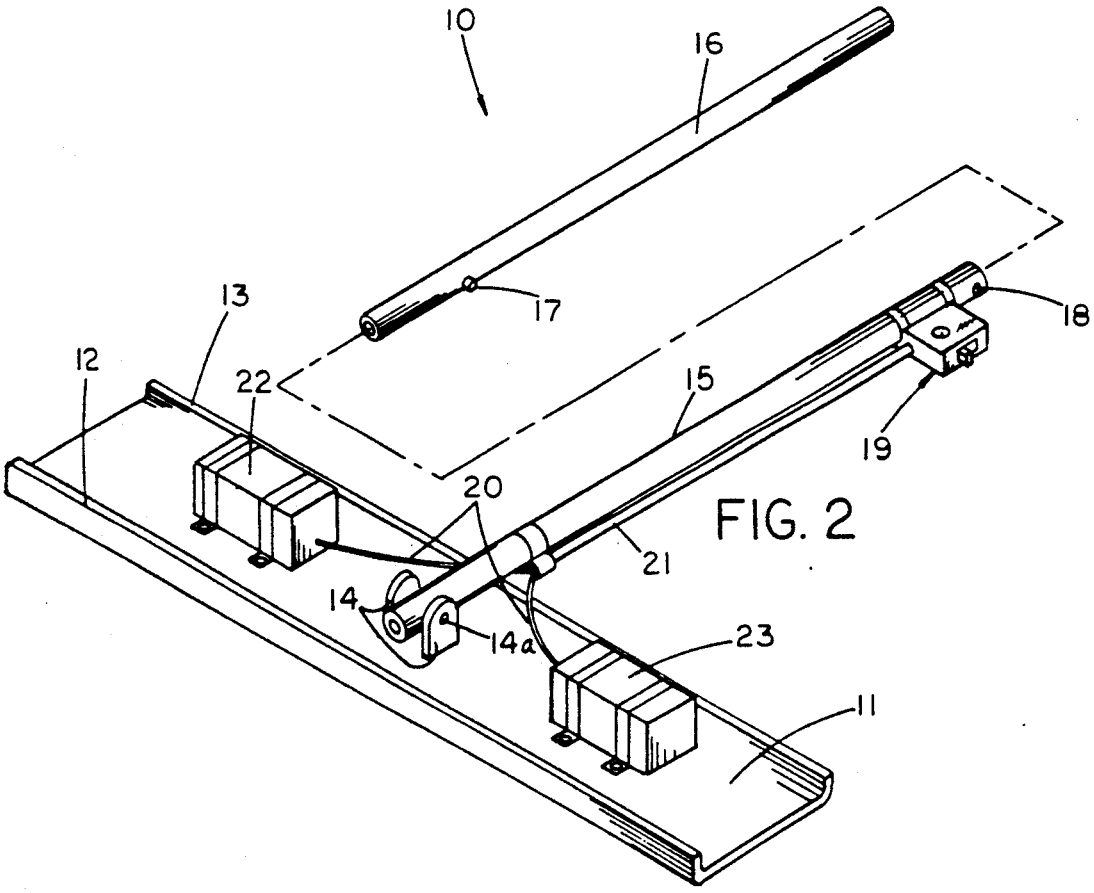
FIG. 2 is an isometric illustration of the instant invention.

More specifically, the vibratory concrete float apparatus 10 of the instant invention as illustrated in FIG. 2 substantially comprises a float plate 11 of a generally planar bottom surface, to include parallel forward and rear flanges 12 and 13 extending upwardly from the float plate relative to respective forward and rear side portions of the float plate 11. The float plate 11 further includes a plurality of spaced parallel mounting flanges 14 pivotally mounting a first handle tube 15 therebetween about a pivot axle 14*a*. As illustrated, a second handle tube 16 including a retractable lock pin 17 is arranged for reception within a first handle tube receiving bore 18 to provide for extension of the first and second handle tubes together. A drive motor 19 is mounted to the first handle tube and includes a guide tube 21 extending therefrom parallel to the first handle tube 15 and spaced relative to the mounting flanges 14, and includes a plurality of drive motor flexible output drive cables 20 directed therethrough, with a single drive cable 20 extending into a respective first and second vibrator 22 and 23 that are mounted fixedly to the top surface of the float plate 11 an equal distance relative to the first handle tube 15.

In this manner, vibratory energy is attained through the vibratory motors that are of conventional construction as set forth in the prior art, such as exemplified in the U.S. Pat. No. 3,918,214 incorporated herein by reference. The direct drive cables permit the drive motor to be mounted in a remote orientation for ease of manipulation of the organization in use.

Figure 3:
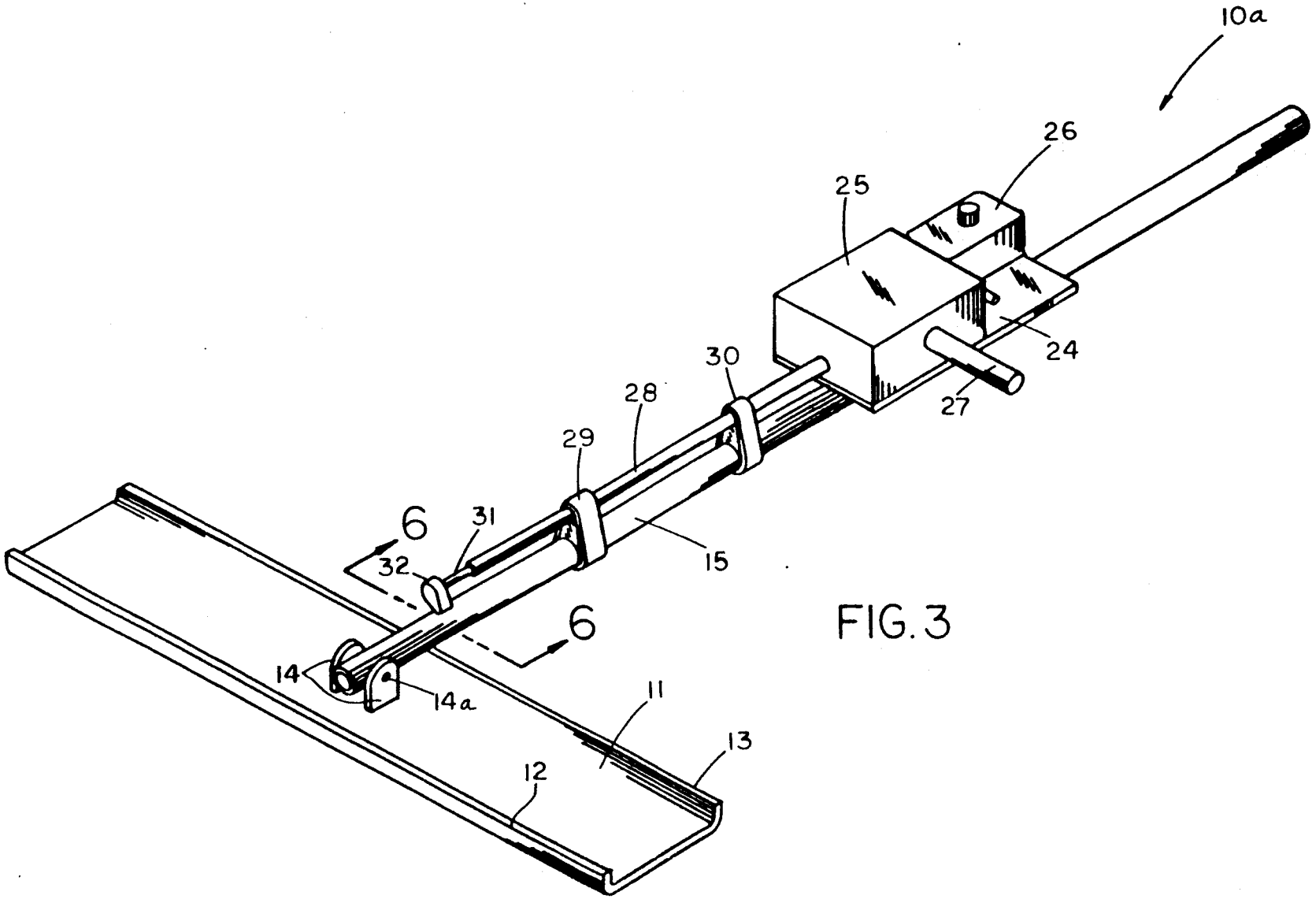
FIG. 3 is an isometric illustration of a further aspect of the invention.
Figure 4:
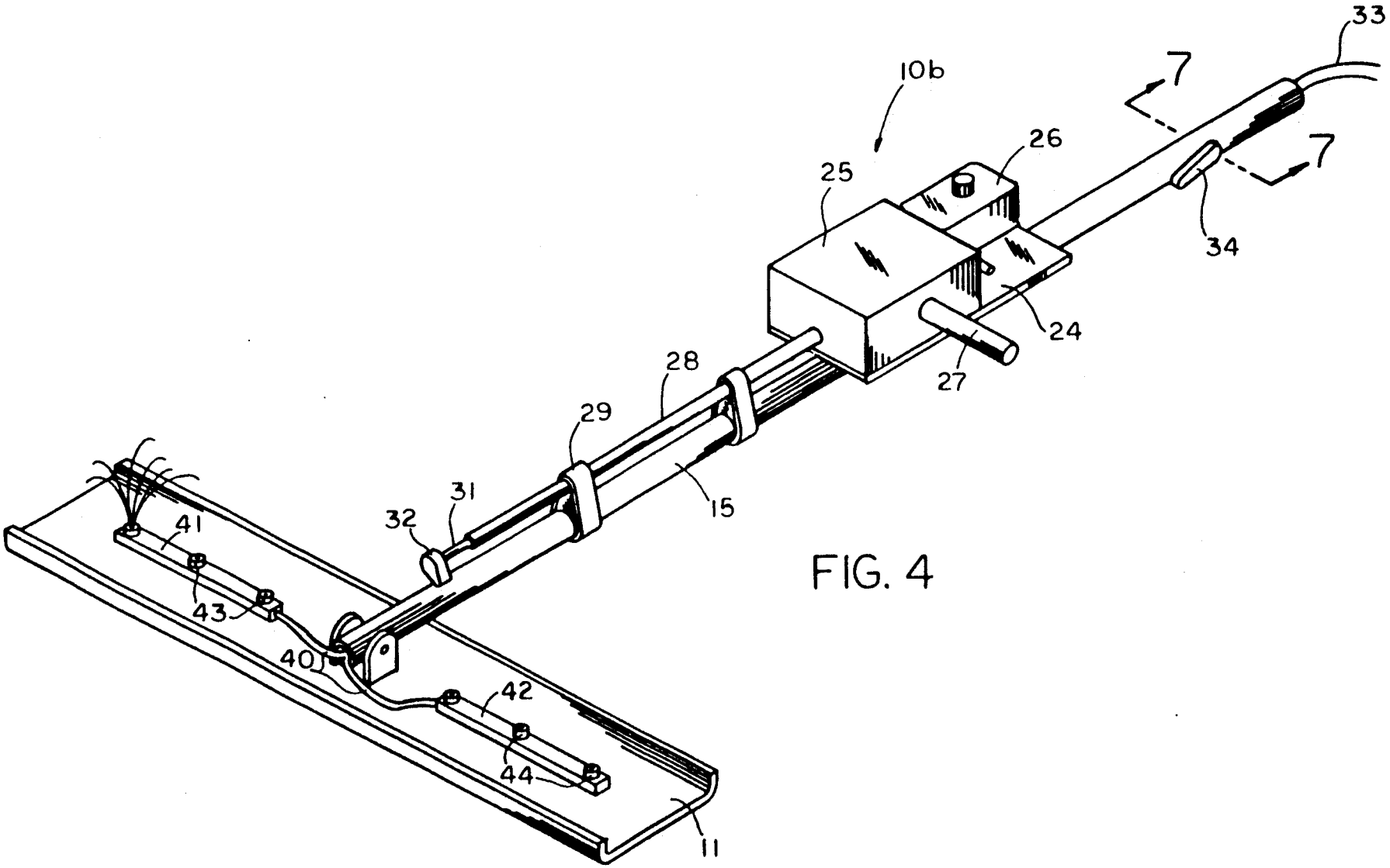
FIG. 4 is an isometric illustration of a yet further aspect of the invention.

The FIG. 3 illustrates the apparatus 10*a* to include a mounting plate 24 fixedly mounted to a top surface of the first handle tube 15, with the mounting plate 24 including a drive motor 25 and a fuel reservoir 26 directed thereto. A handle and speed control 27 extends laterally relative to the drive motor 25 orthogonally oriented relative to the first handle tube 15 for use as a throttle control and handle of a typical gasoline motor to be utilized as a drive motor 25 in association with the fuel tank 26. The guide tube 28 is mounted in a parallel relationship relative to and spaced from the first tube 15 to include first and second positioning mounts 29 and 30 mounting in a fixed relationship the guide tube 28 in the spaced parallel relationship above the first handle tube 15. A drive motor output shaft 31 rotatably directed through the guide tube 28 terminates in an eccentric member 32 mounted thereto, whereupon rotation of the eccentric member 32 by the drive motor 25 directs vibratory energy from the first handle tube 15 to the float plate 11.

Figure 8:
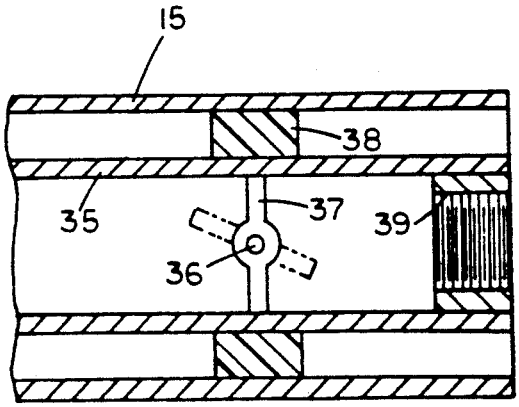
FIG. 8 is an orthographic view, taken along the lines 8—8 of FIG. 7 in the direction indicated by the arrows.

The apparatus 10*b* includes the structure of FIG. 3, but to further include a fluid delivery conduit 33 directed into the tubular first handle tube 15 spaced above a valve organization to include a fluid valve handle 34, with the fluid valve handle 34 including a valve rod 36 orthogonally directed into the handle tube 15, with a valve plate 37 rotatably mounted within a first handle tube central conduit 35 in fluid communication with the fluid delivery conduit 33 through a conduit coupling portion 39, as illustrated in FIG. 8. The valve plate 37 is defined by a predetermined diameter substantially equal to a predetermined internal diameter defined by the first handle tube central conduit 35 to permit selective fluid flow through the first handle tube central conduit 35 that extends coaxially aligned and concentric relative to the handle tube 15 and mounted concentrically relative to the handle tube 15 by at least one, and preferably a plurality of, resilient torroidal mounts 38, of a type as illustrated in FIG. 8, to provide cushioning relative to the central conduit 35 minimizing interaction with the tube 15 in its transmission of vibratory energy from the eccentric member 32. The first handle tube central conduit 35 is in fluid communication with a respective plurality of output fluid conduits 40, wherein at least one output conduit 40 is directed into a respective first and second fluid manifold 41 and 42. The respective first and second fluid manifolds 41 and 42 include respective first and second manifold fluid ports 43 and 44 to direct water from the fluid delivery conduit 33 through the ports 43 and 44 for the watering of a concrete pad to be worked by the apparatus of the invention.

Figure 5:
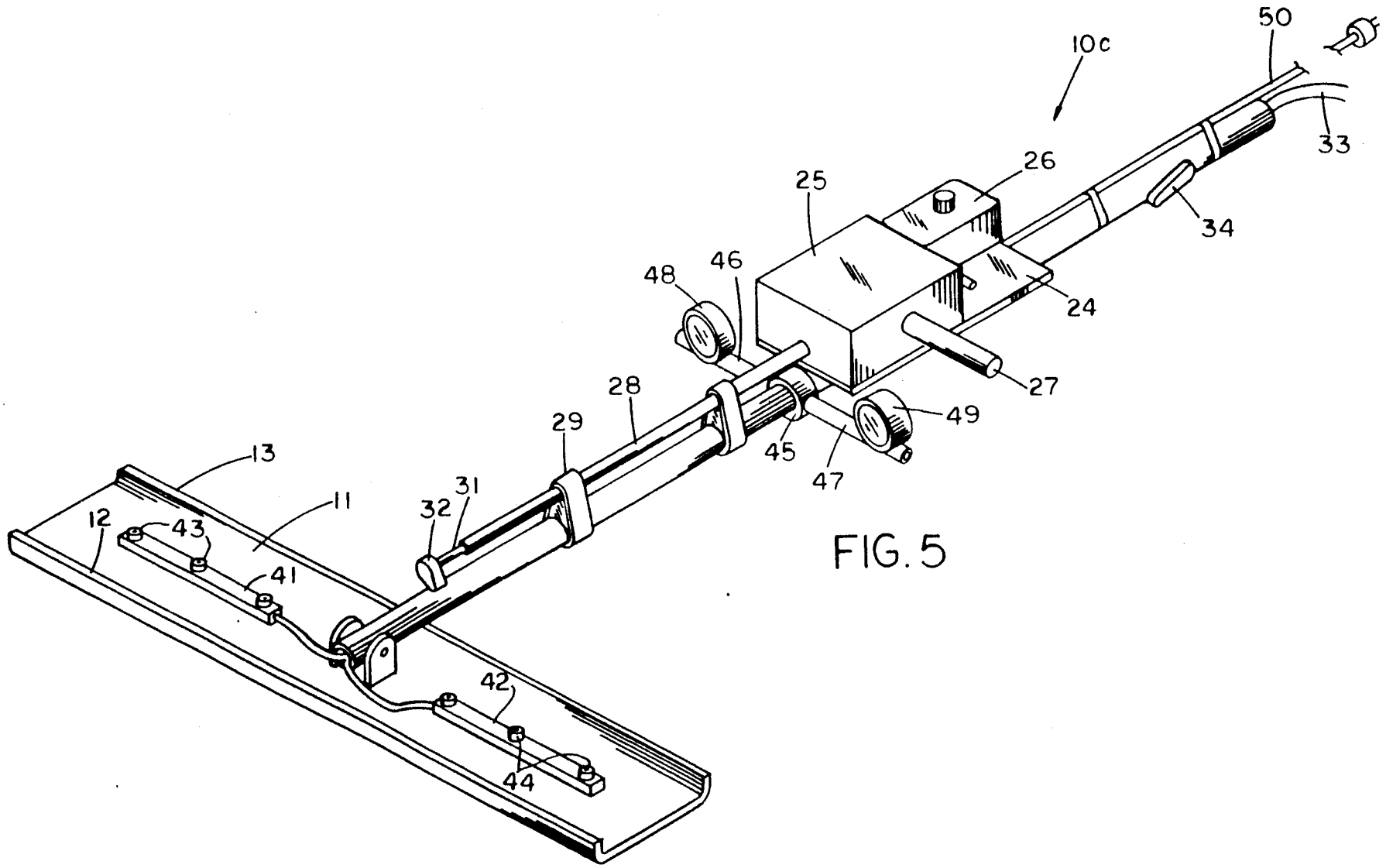
FIG. 5 is an isometric illustration of a still further construction of the instant invention.
Figure 6:
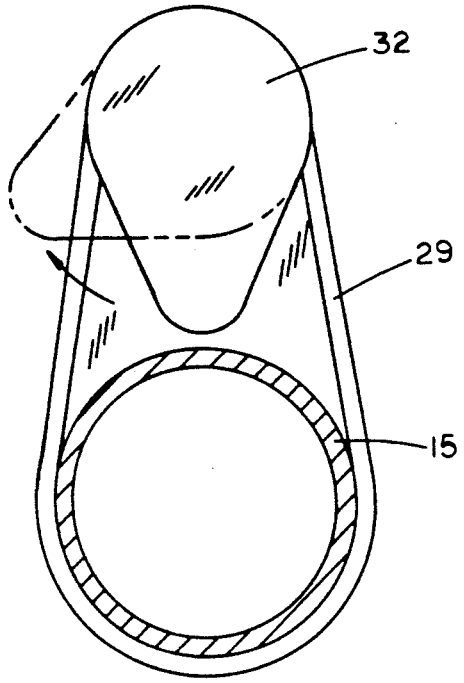
FIG. 6 is an orthographic view, taken along the lines 6—6 of FIG. 3 in the direction indicated by the arrows.
Figure 7:
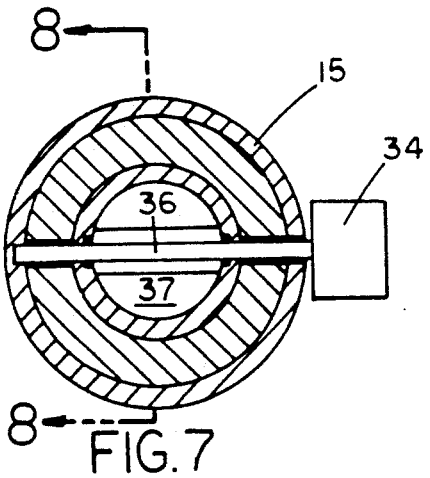
FIG. 7 is an orthographic view, taken along the lines 7—7 of FIG. 4 in the direction indicated by the arrows.

The FIG. 5 illustrates the utilization of a support collar 45 fixedly mounted in circumferential relationship forwardly of the drive motor 25 below the guide tube 28 and employing diametrically directed first and second mounting rods 46 and 47 extending laterally of the handle tube 15 on opposed sides thereof, with the first and second mounting rods 46 and 47 mounting a respective first and second illumination bulb 48 and 49, with utilization of battery power or alternatively, electrical power supply cord 50, to effect illumination of the illumination bulbs 48 and 49 for utilization of the invention during conditions of limited available light.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A vibratory concrete float apparatus, comprising in combination, a float plate, the float plate including a planar bottom surface and a planar top surface, with the float plate including a forward side spaced from a rear side, the forward and rear sides include a respective forward and rear flange extending upwardly therefrom, and a plurality of spaced mounting flanges fixedly mounted medially of the top surface of the float plate, and a handle tube, the handle tube including a first end, the first end pivotally mounted between the spaced mounting flanges and a pivot axle directed orthogonally through the mounting flanges and diametrically through the handle tube for pivotally mounting the handle tube relative to the mounting flanges, and the handle tube including a second end spaced from the first end, and a drive motor means mounted to the handle tube between the first end and the second end, with a vibrator assembly in operative communication with the drive motor means for effecting vibratory energy directed from the handle tube to the float plate, and the drive motor means includes a mounting plate, the mounting plate fixedly mounted to the handle tube, and a drive motor mounted to the mounting plate, and a throttle handle orthogonally directed relative to the handle tube and in operative communication with the drive motor for providing for manual grasping of and speed control of the drive motor, and a guide tube directed into the drive motor, the drive tube extending along and above the handle tube spaced therefrom, and including at least one rigid positioning mount secured to the handle tube and the guide tube, and an output shaft in operative communication with the drive motor, and the output shaft extending forwardly of the guide tube, with the output shaft terminating in an eccentric member, the eccentric member spaced above the guide tube and arranged for imparting vibratory energy through the at least one positioning mount into the guide tube and into the float plate, and a handle tube central conduit concentrically mounted within the handle tube extending from the second end towards the first end, and the first handle tube central conduit including a fluid conduit coupling, and a fluid conduit, with the fluid conduit secured in fluid communication to the handle tube central conduit through the fluid conduit coupling, and a valve member, the valve member including a valve plate rotatably mounted within the handle tube central conduit, and the valve plate defined by a predetermined diameter, and the handle tube central conduit defined by a predetermined internal diameter substantially equal to the predetermined diameter, and a valve rod diametrically directed through the valve plate, the valve rod diametrically directed through the handle tube extending exteriorly thereof, and a valve rod handle orthogonally mounted to the valve rod to permit manual rotation of the valve plate within the handle tube central conduit.

2. An apparatus as set forth in claim 1 including a plurality of output fluid conduits in fluid communication with the handle tube central conduit, the output fluid conduit extending exteriorly of the handle tube first end and including a respective first and second fluid manifold positioned on opposed sides of the handle tube, with the first and second fluid manifold fixedly mounted to the float plate, and at least one output fluid conduit secured to each of said first and second fluid manifolds, and the first fluid manifold and the second fluid manifold including a respective plurality of first and second manifold fluid ports to direct fluid from the fluid conduits exteriorly of the float plate.

3. An apparatus as set forth in claim 2 including a support collar fixedly mounted to the handle tube adjacent the mounting plate, the support collar including respective first and second mounting rods, the first and second mounting rods longitudinally aligned and extending on opposed sides of the handle tube, the first mounting rod including a first illumination bulb, the second mounting rod including a second illumination bulb, with the first and second illumination bulbs oriented forwardly of the mounting tube, and electrical power supply means for directing electrical energy to the first and second illumination bulbs for providing illumination during periods of limited available light.

* * * * *